US005741107A

United States Patent [19]

Georg

[11] Patent Number: 5,741,107

[45] Date of Patent: Apr. 21, 1998

[54] REFUSE COLLECTION VEHICLE

[76] Inventor: Edgar Georg, Auf der Seelhardt 10, D-57638 Neitersen, Germany

[21] Appl. No.: 583,122

[22] PCT Filed: May 11, 1995

[86] PCT No.: PCT/EP95/01791

§ 371 Date: Jun. 5, 1996

§ 102(e) Date: Jun. 5, 1996

[87] PCT Pub. No.: WO95/31388

PCT Pub. Date: Nov. 23, 1995

[30] Foreign Application Priority Data

May 13, 1994 [DE] Germany ..... 9407869 U

[51] Int. Cl.[6] ..... B65F 3/04

[52] U.S. Cl. ..... 414/408; 414/525.6; 414/501; 414/498; 220/1.5; 100/215

[58] Field of Search ..... 414/498, 499, 414/500, 406, 407, 408, 409, 403, 501, 525.3, 525.2, 525.1, 525.6, 517, 491, 492; 220/1.5, 361, 601, 345; 100/218, 215, 227

[56] References Cited

U.S. PATENT DOCUMENTS

| | | | |
|---|---|---|---|
| 3,451,571 | 6/1969 | Brisson | 414/525.6 X |
| 3,490,631 | 1/1970 | Smith | 414/525.6 X |
| 5,064,332 | 11/1991 | Edelhoff et al. | 414/408 |
| 5,474,413 | 12/1995 | Georg | 414/498 X |

FOREIGN PATENT DOCUMENTS

| | | | |
|---|---|---|---|
| 496302 | 7/1992 | European Pat. Off. | 414/408 |
| 2634185 | 1/1990 | France . | |
| 3443320 | 5/1986 | Germany . | |
| 93/15981 | 8/1993 | WIPO . | |

*Primary Examiner*—Frank E. Werner
*Attorney, Agent, or Firm*—Spencer & Frank

[57] ABSTRACT

A vehicle for receiving and transporting refuse materials including a collection container including: a front end wall defining a filling opening being bounded by a rigid frame; and a door being movable for opening and closing the filling opening. The vehicle further includes an operating device for moving the door, and a hopper defining an output opening in communication with the filling opening and bounded by a counterframe disposed adjacent the frame for defining a communication region between the hopper and the collecting container. The hopper has a tubular extension extending into the filling opening up to the plane of movement of the door; and a press disposed in the hopper. The press includes a stamp movable into and out of an interior of the collection container through the filling opening, the stamp having an inclined front surface whose upper edge is set back with respect to a lower edge thereof in a direction toward the interior of the collection container. The press further includes a drive operatively connected to the stamp for moving the stamp, the operating device and the drive being configured such that, during a closing of the door, a lower edge of the door remains in contact with the front surface of the stamp during the retracting motion of the stamp until the door is completely closed. The vehicle further includes a seal disposed on an end face of at least one of the frame and the counterframe for sealing the communication region.

4 Claims, 8 Drawing Sheets

REFUSE COLLECTION VEHICLE

FIELD OF THE INVENTION

The invention relates to a vehicle for receiving and transporting waste materials, having a collection container which is detachably disposed on the vehicle, behind the cab, and has a filling opening at its end on the side of the cab, the vehicle further having a device for receiving at least one refuse container, which device empties the received refuse container into a discharge hopper disposed behind the cab and cooperating with a press, the output opening of which hopper is associated with the filling opening of the collection container disposed in the lower region of the end wall.

BACKGROUND OF THE INVENTION

A vehicle of the above type is shown and described in WO/93/15981. In a preferred embodiment of this vehicle, the collection container can be detachably connected to the vehicle, so that an empty container can be received by the vehicle and the filled container can be removed from the vehicle and transported by a vehicle serving strictly as a means of transport to a dumping site or other unloading site. The collection container in this instance can be provided with support legs, as known from, for example, so-called interchangeable superstructures, so that the supported collection container can be received by the vehicle in that the vehicle travels backwards under the collection container and, after corresponding positioning, the collection container is connected to the vehicle. The vehicle can also be provided with a so-called hook lifting device, so that the collection container, which is provided on its end wall with a corresponding receiving eyelet, can be pulled onto the vehicle frame by the gate-shaped lifting arm which is pivotable in the longitudinal direction of the vehicle, and removed from it again in a corresponding, reversed movement.

A significant problem of removable collection containers of this type lies in closing and detaching the container after filling without allowing residual refuse to fall onto the vehicle or the surrounding area.

in the known vehicle, the problem was solved in that the output opening of the discharge hopper has a tubular extension that projects into the collection container through the filling opening disposed in the lower region of the end wall of the collection container, with sealing means being provided which seal the tubular extension against the filling opening. Thus, during the filling process a perfect seal is achieved for the transition point between the press and container. Because the refuse pressed into the collection container "springs back" to a considerable extent when the pressing pressure is removed, the significant problem exists of detaching the filled collection container from the vehicle without allowing refuse to fall out of the filling opening. In the known vehicle, this problem was solved by a known tubular extension which extends into the collection container, with the filling opening being able to be at least partially closed by a blocking plate which can pivot into the interior of the container when, during detachment of the container, the container is pulled far enough away from the tubular extension that the closing door can be lowered.

SUMMARY OF THE INVENTION

The object of the invention is to improve this region of a collection vehicle of this type, both with respect to function and construction, in order to achieve a perfect seal during filling and a clean seal during detachment of the collection container.

In accordance with the invention, this object is accomplished by providing a vehicle for receiving and transporting refuse materials which comprises: a vehicle frame; a cab disposed on the vehicle frame; and a collection container detachably connected to and disposed on the vehicle frame behind the cab. The collection container includes: a front end wall at an end thereof closest to the cab, the front end wall defining a filling opening therein at a lower region thereof, the filling opening being bounded by a frame; and a door disposed at the front end wall and being movable for opening and closing the filling opening thereby defining a plane of movement. The vehicle further includes an operating device operatively connected to the door for moving the door for opening and closing the filling opening, and a discharge hopper disposed behind the cab and defining an output opening in communication with the filling opening of the collection container, the output opening being bounded by a counterframe disposed adjacent the frame of the filling opening for defining a communication region between the discharge hopper and the collecting container. The discharge hopper has a tubular extension extending into the filling opening up to the plane of movement of the door and a press disposed in the discharge hopper. The press includes a stamp movable into and out of an interior of the collection container through the filling opening thereby defining, respectively, an advancing motion and a retracting motion, the stamp having an inclined front surface whose upper edge is set back with respect to a lower edge thereof in a direction toward the interior of the collection container. The press further includes a drive operatively connected to the stamp for moving the stamp into and out of the interior of the collection container, the operating device and the drive being configured such that, during a closing of the door, a lower edge of the door remains in contact with the front surface of the stamp during the retracting motion of the stamp until the door is completely closed. The vehicle additionally includes a device for receiving a refuse container for emptying contents of the refuse container into the discharge hopper; and a seal disposed on an end face of at least one of the frame and the counterframe for sealing the communication region between the collection container and the discharge hopper. Because the filling opening of the collection container is limited at the end wall of the container by a frame, and the output opening of the press also has a corresponding counterframe, it is possible to "dock" the collection container with its filling opening at the output opening and press the seal disposed on the end face of at least one frame against the end face of the other frame in the manner of a pressing seal. In this instance, the seal is advisably disposed on the end face of the counterframe, that is, on a part which remains on the vehicle, precluding the danger of damage by unauthorized persons, which danger may exist if the seal remains on the frame connected to the container and is freely accessible when removed containers are not being watched. Because the seal is only pressed in this seal arrangement, and no relative movements occur, wear to the seals is avoided. The associated end face of the other frame, which forms the sealing surface, is freely accessible and can be cleaned in a simple manner prior to docking of the container.

In an advantageous embodiment of the invention the door defines a plurality of receptacles thereon and is guided vertically on the collection container in its movement for opening and closing the filling opening. Additionally, the frame of the filling opening includes guides thereon for guiding the door in its movement for opening and closing the filling opening; and the operating device includes: an operating drive disposed adjacent the output opening of the hopper for moving the door to open and close the filling opening; and a plurality of carriers operatively connected to the drive and adapted to be connected to respective ones of the receptacles for moving the door to open and close the filling opening in response to an actuation of the operating drive.

Here the particular advantage ensues from the arrangement of the frame limiting the filling opening of the collection container in that this frame also receives the guides for the closing door. Because of the already necessary rigidity of the frame limiting the filling opening, the guides for the closing door are secured against deformity.

The instant invention has the further advantage that the output opening only has a relatively short tube-like extension, so that when the collection container is received, this tubular extension is to be "threaded" into a mated with the filling opening in only a short sliding process. This short sliding path is particularly advantageous if the vehicle is provided with hook lifting equipment for receiving the collection container. The further advantage is that, during closing of the closing door, which is preferably guided vertically on the container, this door is guided closely past the edge of the tubular extension defining the output opening, so that no intermediate spaces containing refuse can be present, because the stamp of the press is guided into the interior of the collection container by the tubular extension.

In a further embodiment, the operating device includes a crossbeam disposed above the counterframe and adapted to be guided up and down by the operating drive, the plurality of carriers comprising mandrel-like carriers disposed on the crossbeam. The arrangement of a crossbeam which is preferably provided with mandrel-shaped carrier means results in a structurally simple and very compact operating apparatus which is pushed, in a simple manner, with its carrier mandrels into a correspondingly-embodied receptacle of the closing door when the collection container is docked. Because the crossbeam is disposed above the counterframe, a corresponding recess creates a sufficient free space for an eyelet of a collection container equipped for hook-lifting operation, for example.

In an another embodiment of the invention, the operating drive comprises two hydraulic cylinders connected to respective ends of the crossbeam and movable synchronously with respect to one another. According to this embodiment, a compactly-designed operating apparatus results in connection with the crossbeam, which apparatus can be disposed on both sides of the output opening of the press. The synchronous operation of the two hydraulic cylinders can be effected by a synchronizing control in such a way that the two hydraulic cylinders are configured identically and are acted upon by the same quantity of fluid by way of a quantity divider. In another embodiment, it is possible to configure the two cylinders as dual-surface cylinders, in which case the cylinders are of different sizes but are matched to one another in terms of size. This matching is effected in such a way that the displacement volume of the annular chamber of the first hydraulic cylinder, the chamber being defined on the side of the piston rod, is identical in size to the piston chamber of the second hydraulic cylinder, so that when the first hydraulic cylinder is pushed forward, the fluid volume of the annular chamber of the first hydraulic cylinder is pushed forward into the piston chamber of the second hydraulic cylinder, forcing synchronized operation.

Because of the configuration of the front surface of the stamp of the press according to the invention, following completion of the filling process, it is possible to guide the closing door, matching it to the retraction movement of the stamp, such that the lower edge of the closing door is guided across the front surface of the stamp when the filling opening is closed, and residual refuse adhering to the stamp is shaved off and the stamp of the press can therefore be retracted completely without refuse adhering to it. During the course of this movement, a simultaneous exit of the refuse due to the effect of compacting tension is avoided. If the locking between the vehicle and the collection container is subsequently released, the collection container can be removed from the vehicle without refuse being scattered.

DETAILED DESCRIPTION OF THE DRAWINGS

Figure 1:
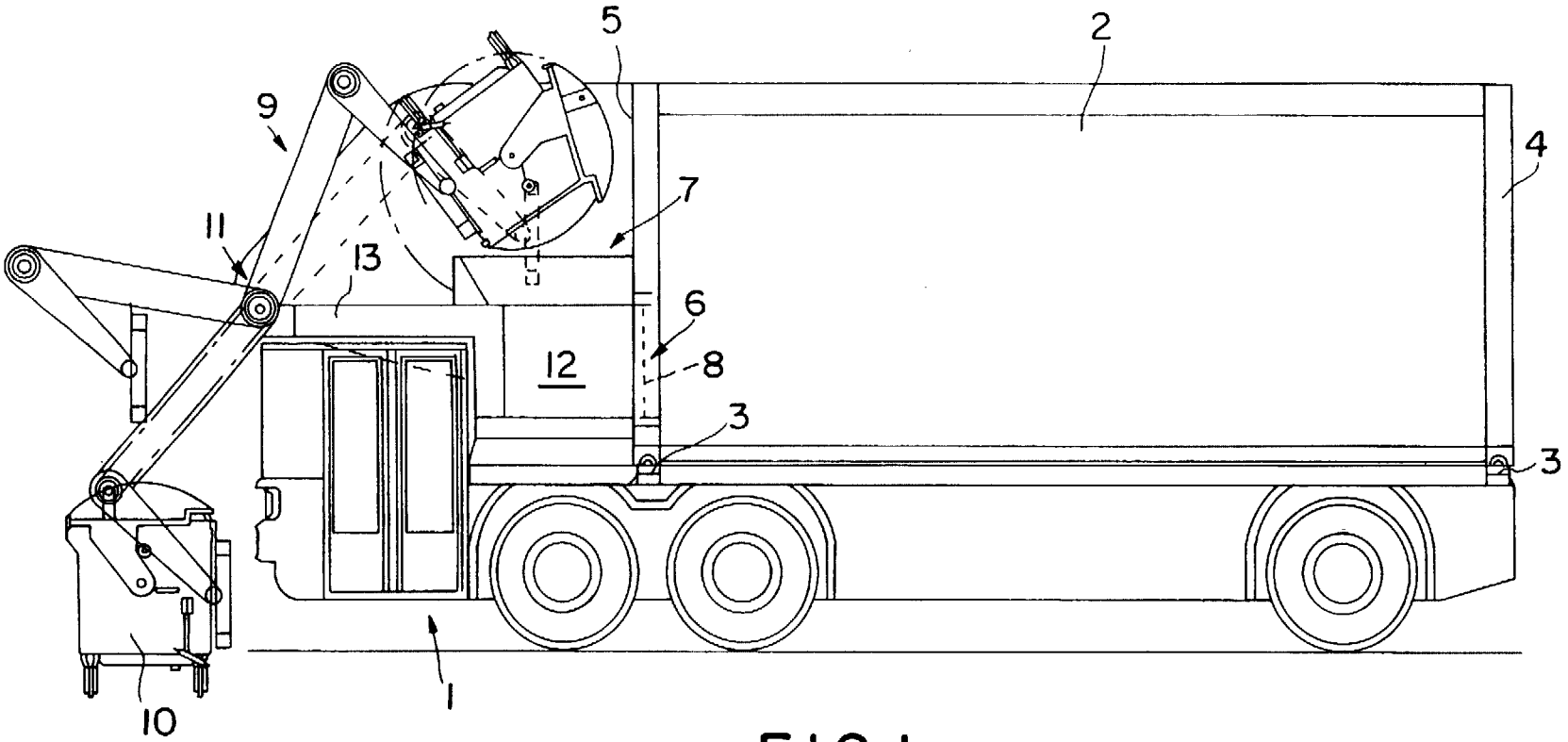
Figure 2:
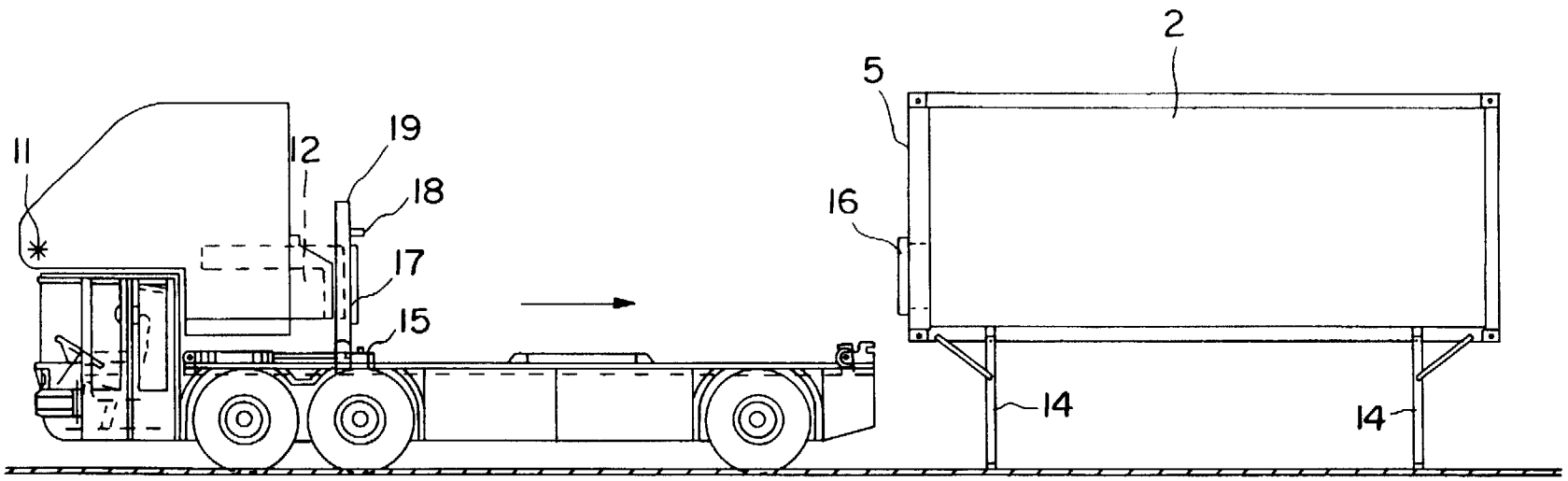
Figure 3:
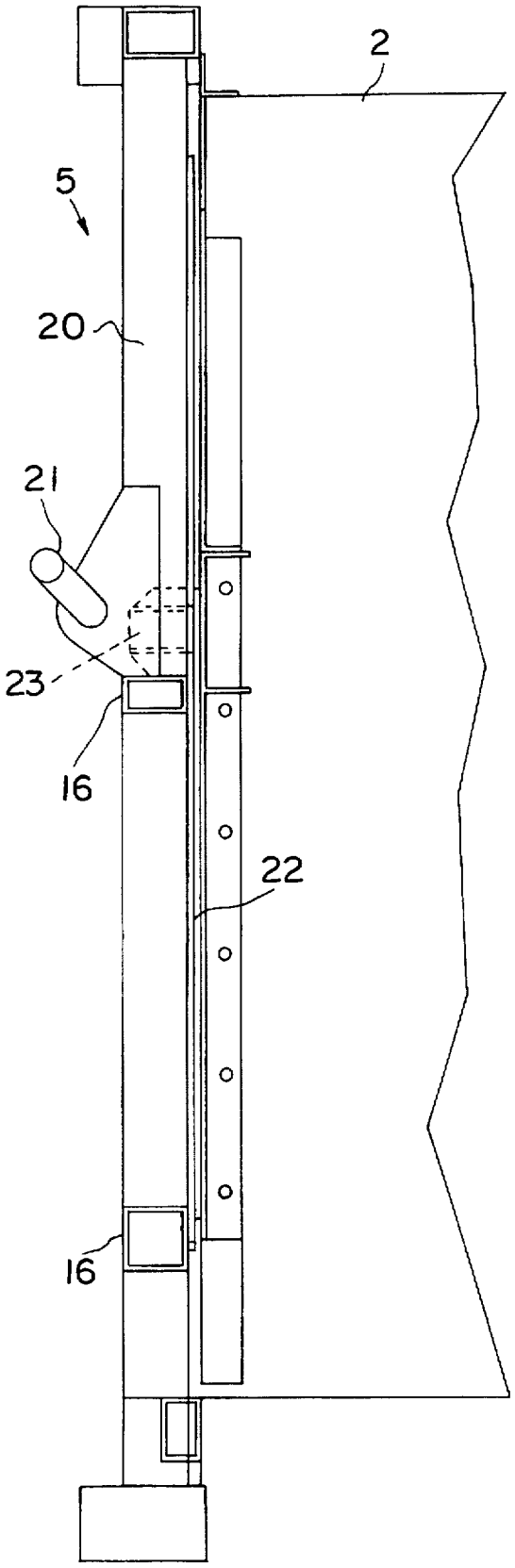
Figure 4:
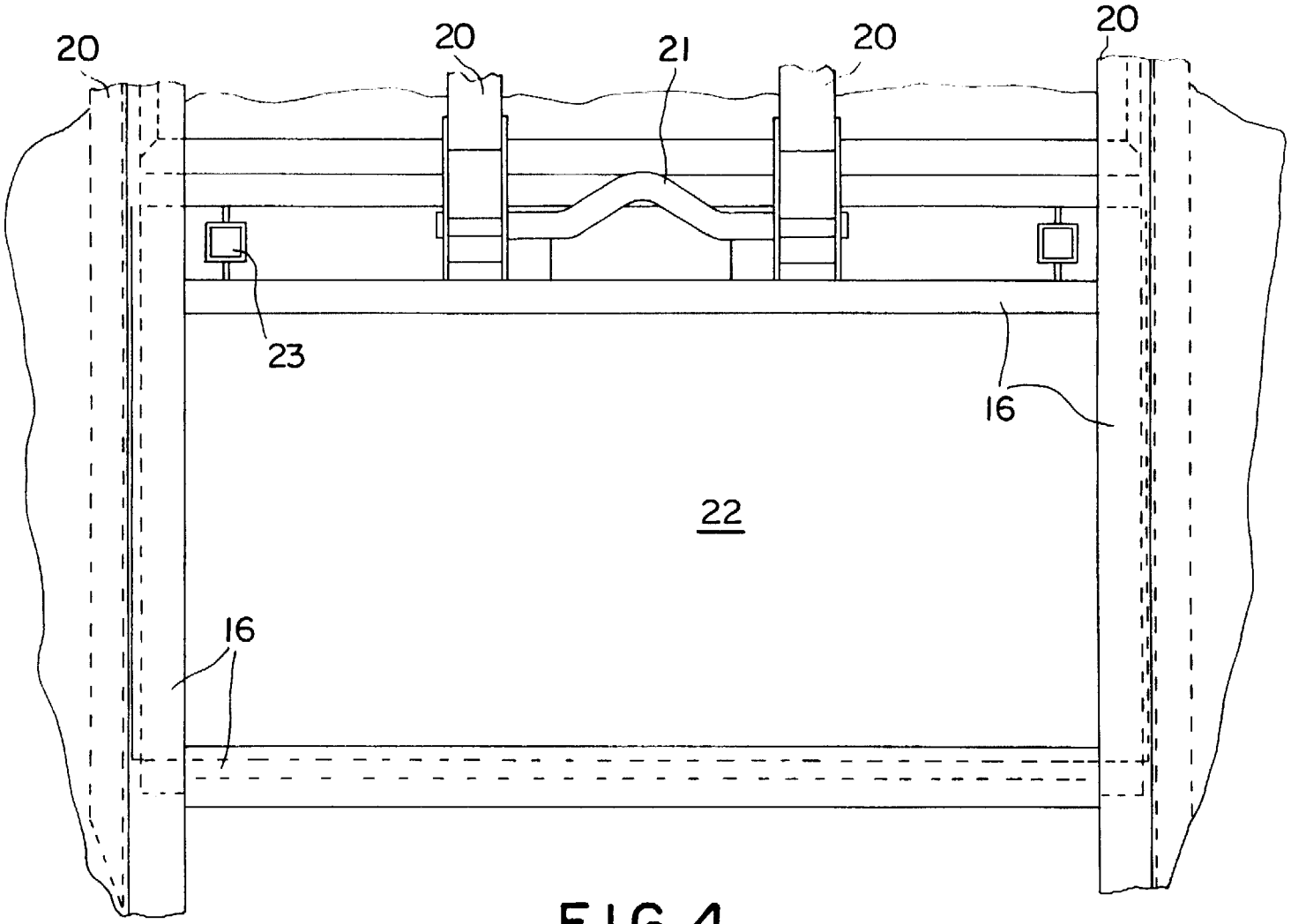
Figure 5:
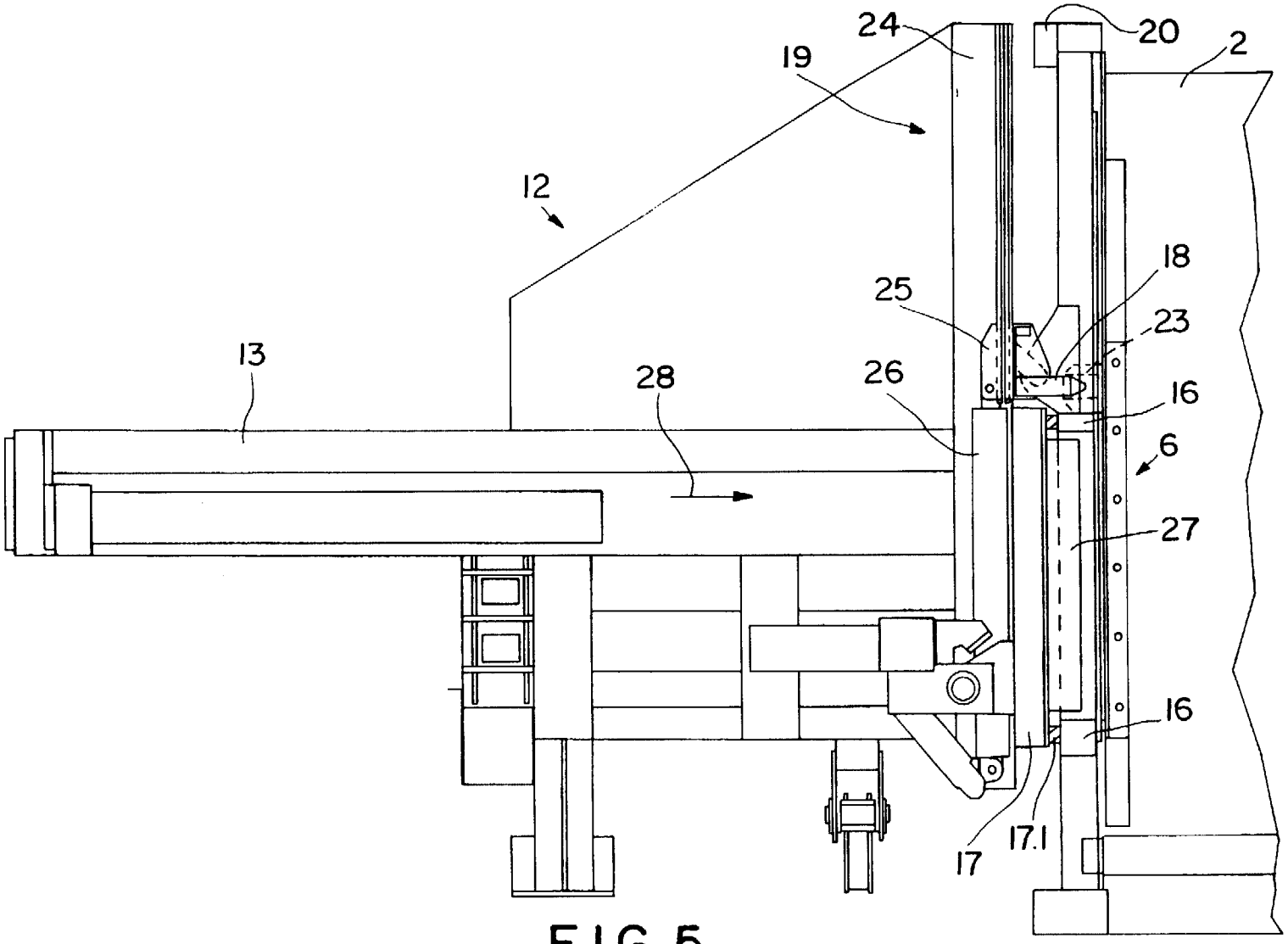
Figure 6:
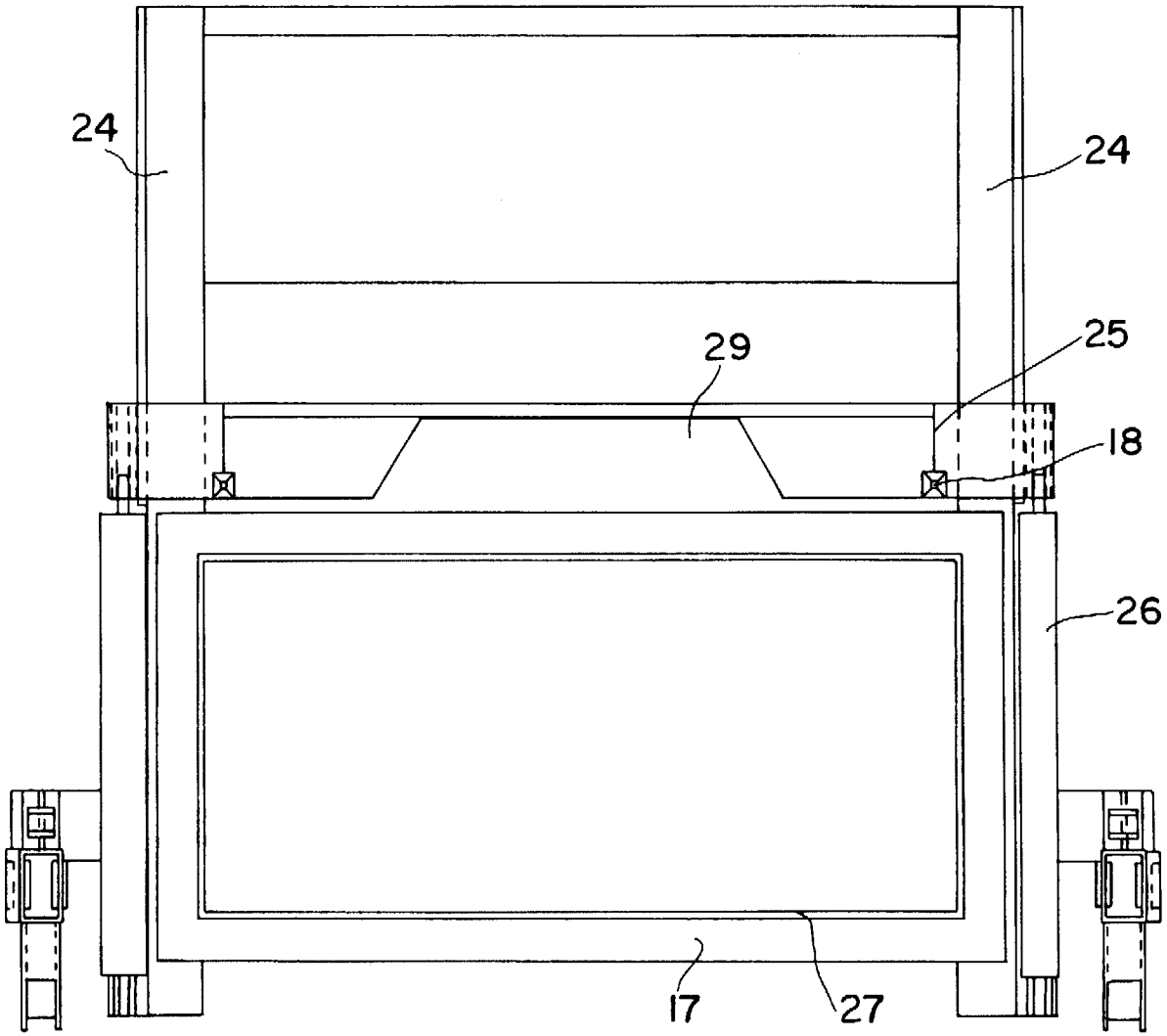
Figure 7:
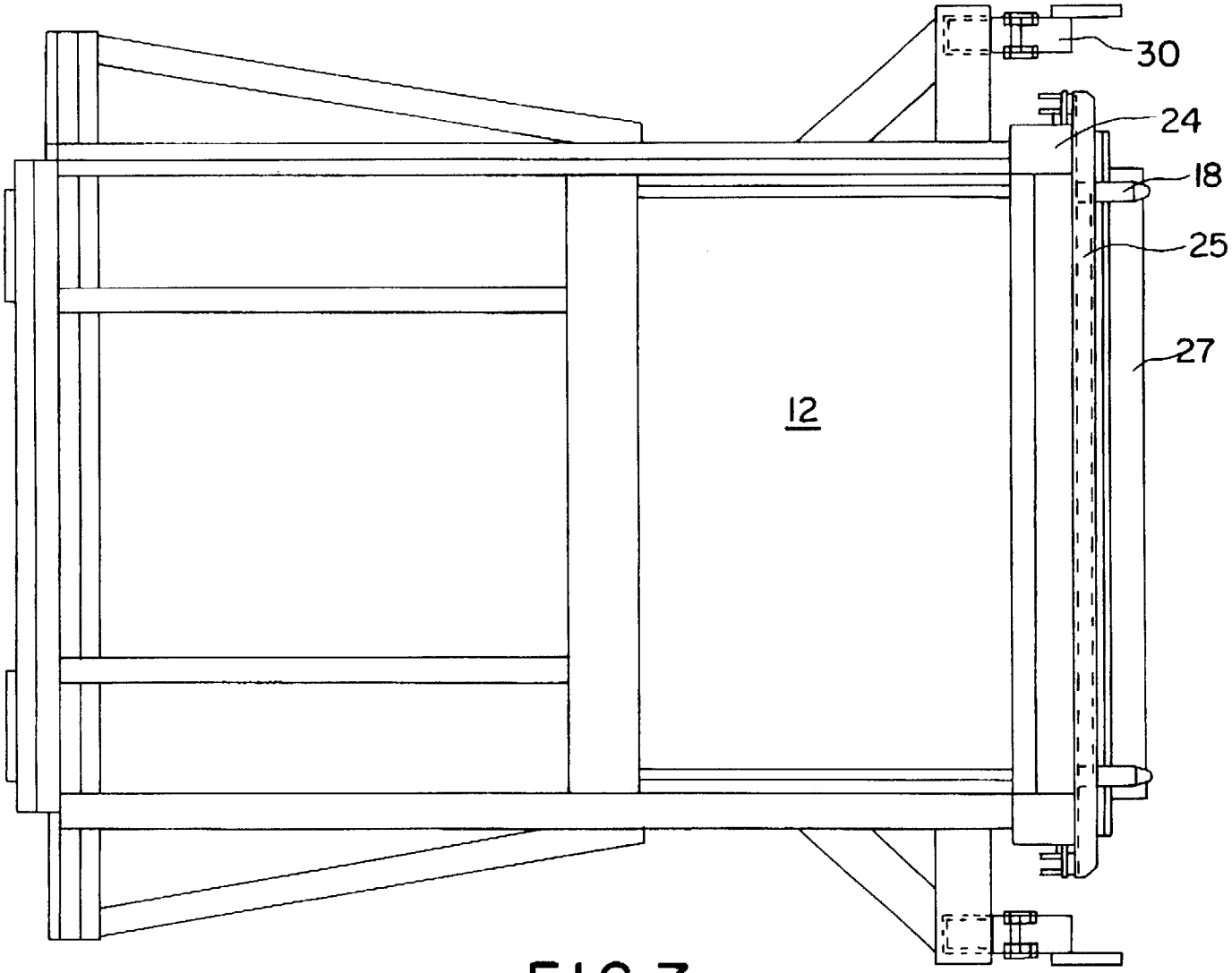
Figure 9:
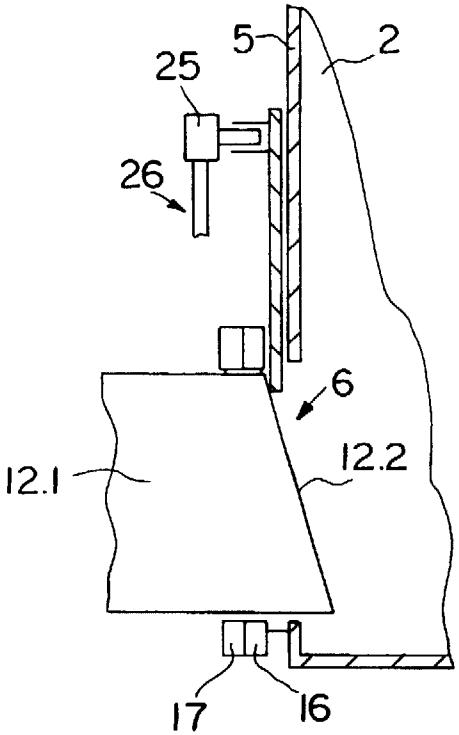
Figure 8:
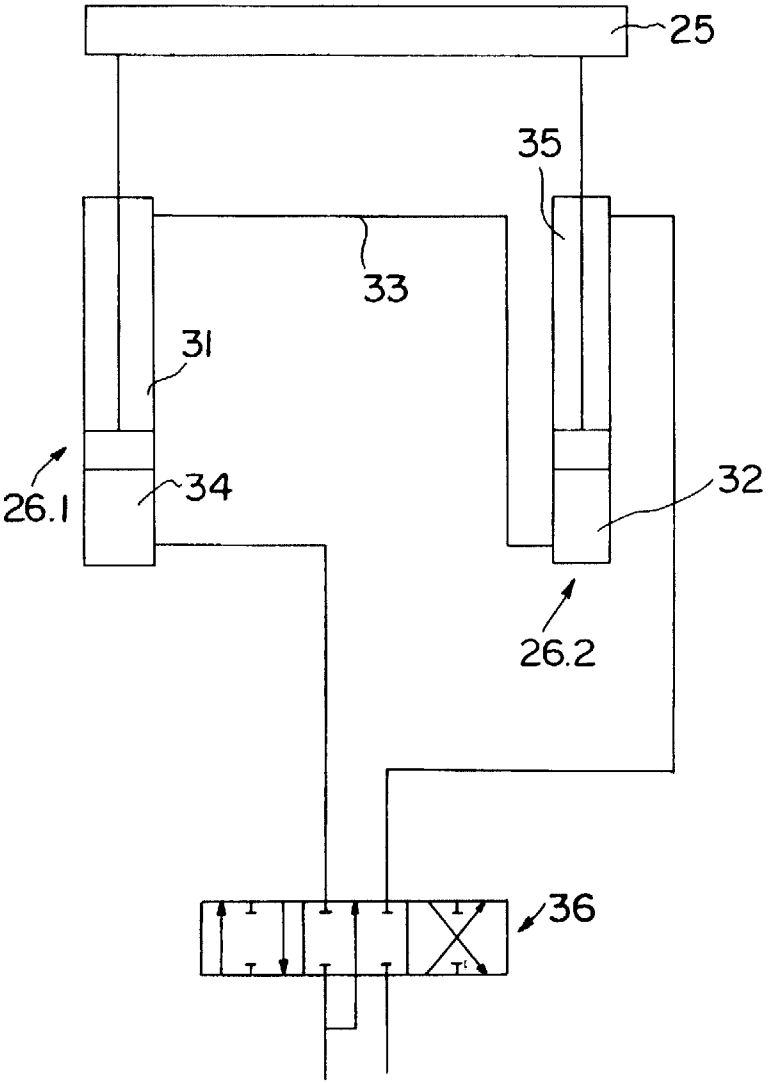

The invention is described in detail in conjunction with schematic drawings of an embodiment thereof. Shown are in:

FIG. 1 a side view of a vehicle having a receiving apparatus,

FIG. 2 the vehicle according to FIG. 1 with the collection container removed,

FIG. 3 a vertical section, on an enlarged scale, through the end wall of a collection container, FIG. 4 a partial section of the filling opening of the collection container according to FIG. 3, FIG. 5 the region of a coupling between the collection container and the discharge hopper, FIG. 6 a front view of the output opening of the discharge hopper, FIG. 7 a top view of the region of the output opening, FIG. 8 a schematic view of the arrangement of an operating device for the closing door at the collection container, FIG. 9 the courses of movement of the press stamp and closing door, which are matched to one another, after the filling process has ended.

DETAILED DESCRIPTION OF THE INVENTION

The vehicle 1 shown in FIG. 1 for receiving and transporting refuse materials is equipped with a collection container 2, which is detachably secured to the vehicle frame by way of closures 3. The collection container 2 can be removed from the vehicle in different ways following the release of the closures 3. This can either be effected in that the collection container has supports which can be extended downwardly, as illustrated in detail in FIG. 2, so that the vehicle equipped with a lowering device for lowering can drive away after the supported collection container has been lowered. Reception is then effected in reverse order.

It is also possible, however, to provide the vehicle with a so-called hook lift, by means of which a received collection container is first moved a short distance horizontally toward the back in order to be removed, and is then displaced further toward the back by the pivoting of the lifting hook, so that the vehicle can drive forward as soon as the collection container touches the ground with its rear edge, with further pivoting of the lifting hook, and place the collection container on the ground. The reception of an empty collection container is effected in the same manner. Hook-lifting constructions of this type are known, and their design need not be described in detail here. The arm supporting the hook must be embodied in yoke or frame shape, however, so that it extends around the output opening of the discharge hopper.

The rear end wall 4 of the collection container 2 is typically configured as a flap which can be locked, so that the contents of the collection container can be emptied by means of tipping after the locking has been opened. The collection container can also be configured such that the front end wall is configured as an emptying flap and can be folded up completely for the purpose of emptying.

Provided in the lower region of the front end wall 5 is a filling opening 6, which can be closed by, for example, a sliding door which can be displaced and stopped vertically and is attached to the outside of the filling opening, as explained in more detail below in conjunction with the following figures.

Disposed on the vehicle itself, in the space between the cab and the end wall 5 of the collection container 2, is a press which has hydraulic press cylinders and a press stamp. The press is provided with a discharge hopper 7 whose output opening is formed by a tubular extension 8 that is dimensioned such that it extends into the region of the filling opening 6 of the collection container 2. If, when the press stamp is retracted, refuse is thrown into the discharge hopper 7, it can be pushed into the collection container 2 by the tubular extension 8 of the output opening by way of the press stamp. The region between the output opening of the discharge hopper 7 and the filling opening 6 is sealed against the environment with a seal that will be described in further detail below.

The vehicle 1 is provided with a device 9 for receiving and emptying a refuse container 10; in the illustrated embodiment, the device is formed by a two-part pivoting arm pair conceptualized such that it can be pivoted out of the illustrated lower receiving position, through the illustrated intermediate position and into the emptying position, by an angle of approximately 180°. The illustration in dashed lines shows the inoperative position during driving operation. The pivoting arm pair in this instance is configured such that, during the pivoting movement, the refuse container is held vertically and cannot be pivoted into the shown emptying position until the emptying position above the discharge hopper 7 is reached by means of a separate pivot drive. In the illustrated embodiment, the pivoting arm pair is seated, by means of a corresponding pivot bearing 11, in the upper front region of the cab, on a support 13 that extends over and beyond the cab and is connected to the press 12.

FIG. 2 illustrates the receiving process for a collection container 2 by a vehicle 1 of the embodiment described in detail above. In order to receive the collection container 2 provided with support legs 14, a vehicle is used which is configured for so-called interchangeable open bodies and can be lowered in its entirety by hydraulic or pneumatic systems. The vehicle in this instance drives backward under the collection container 2 until the end face 5 of the collection container comes to rest on a receiving and positioning device 15, by means of which the collection container 2 comes to rest with its filling opening 6 limited by a frame 16 against a corresponding counterframe 17 at the output opening of the press 12, and carriers 18 of an operating device 19 engage a corresponding receptacle in the closing door on the collection container, which door will be described in further detail below. In the illustrated embodiment, the receiving apparatus 9 is indicated only by its pivot bearing 11.

FIG. 3 shows, on an enlarged scale and in vertical section, the end wall 5 of the collection container 2. The end wall 5 formed by a door framework 20 to be so rigid that a receiving eyelet 21 for lifting operation can also be attached thereto, as shown in the sectional illustration, so that the container can be held in its entirety by the framework 20, even during hook-lifting operation.

The frame 16, which limits the filling opening 6 of the collection container 2, is now integrated into the framework 20, as shown in FIG. 4. The frame 16 in this instance has on its two vertical sides guide slots, in which a closing door 22 which covers the filling opening 6 is held so as to be vertically displaceable. On both sides of its upper end, the closing door 22 has receptacles 23 which the carriers 18 on the operating apparatus 19 can engage during "docking" of the collection container 2 at the press 12. FIG. 4 shows a front view of the filling opening covered by the closing door 22 and the frame which limits the filling opening, whose individual frame sides are characterized by reference numeral 16.

FIG. 5 shows a detailed representation in a side view of the press 12 with the support 13, to the front end of which the pivot bearing 11, not shown in detail here, for the receiving device 9 is secured. In this instance, the vehicle is only indicated by the chassis.

The operating device 19 is connected to the press 12 and is essentially formed by a guide 24 on which a crossbeam 25 can be moved up and down by means of two parallel hydraulic cylinders 26. The crossbeam 25 is disposed at the output opening above the counterframe 17. The mandrel-type carriers 18 engaging the receptacle 23 at the closing door 22 are respectively secured to the two ends of the crossbeam 25.

The output opening of the press 12, which is limited by the counterframe 17, is provided with a tubular extension 27 that extends into the region circumscribed by the counterframe 17 until it is close to the closing door. A peripheral seal 17.1, against which the end face of the frame 16 is pressed during docking of the collection container 2, is preferably disposed on the end face of the counterframe 17, assuring a dust- and odor-tight closure of this transitional region. The collection container 2 is connected directly to the press by way of locking elements not shown in detail here, also in the sliding direction of the press (arrow 28), so that the forces occurring in the longitudinal direction of the vehicle when the refuse is pushed into the collection container are absorbed directly between the press and the collection container.

FIG. 6 shows a front view of the output opening of the refuse press with the counterframe 17 limiting the press, and the tubular extension 27. The crossbeam 25 with the mandrel-like carriers 18 and a recess 29 of the crossbeam 25 can be seen above the counterframe 17; this recess leaves the region of the lifting eyelet 21 free, the eyelet likewise being indicated in FIG. 5. The hydraulic cylinders 26, by means of which the crossbeam 25 can be displaced on the guide 24, can be seen on both sides of the counterframe 17.

FIG. 7 shows a top view of the filling opening of the press 12 with the guides 24 for the crossbeam 25 with the carriers 18, and the tubular extension 27 of the output opening.

Indicated on both sides are the locking elements 30, which are not described in detail here and by means of which the container is also docked securely at the press in the longitudinal direction of the vehicle.

FIG. 8 schematically shows the connection of the hydraulic cylinders 26.1 and 26.2 which move the crossbeam 25. The two cylinders are connected in series and designed such that the annular chamber 31 of the hydraulic cylinder 26.1 on the side of the piston rod corresponds in volume to the volume of the chamber 32 of the hydraulic cylinder 26.2 on the side of the piston. The annular chamber 31 is connected to the piston chamber 32 by way of a line 33. The piston chamber 34 of the hydraulic cylinder 26.1 and the annular chamber 35 of the hydraulic cylinder 26.1 on the side of the piston rod are connected to the pressurized oil supply by way of a corresponding control valve 36.

If the piston chamber 34 of the hydraulic cylinder 26.1 is now acted upon by pressure fluid in order to lift the crossbeam 25, the hydraulic cylinder 26.2 is also moved by the displacement of the pressure fluid from the annular chamber 31 into the piston chamber 32 of the hydraulic cylinder. Because the volume of the annular chamber 31 and the piston chamber 32 are identical, this forces synchronous operation of the two hydraulic cylinders. The pressure fluid located in the annular chamber 35 is conveyed back into the pressurized oil supply by way of the control valve 36.

To close the closing door, the course of movement is effected in the opposite order of the above-described opening movement.

Since refuse containers are continuously emptied into the discharge hopper of the press 12 in the manner described in conjunction with FIG. 1, and these quantities of refuse are continuously pushed into the collection container 2 by the pressing stamp of the press, the container must be removed from the vehicle in the manner described in conjunction with FIG. 2 following complete filling. To prevent refuse from reaching the outside through the filling opening of the collection container during opening of the locking 30 and replacement of the container 2 by the press, the closing door 22 is now lowered in the manner described in conjunction with FIG. 9. In the locked state, the stamp 12.1 of the press 12 which is provided with an inclined front surface 12.2 is displaced into the filling opening 6 of the container 2. Then the stamp 12.1 is pulled so far back by means of a corresponding actuation that the upper edge of the front surface 12.2, which is set back with respect to the lower edge, lies in the plane of movement of the closing door 22. Now the closing door 22 is lowered so far by its operating device that the lower edge of the closing door 22 touches the front surface 12.2 of the stamp 12.1. The stamp 12.1 is subsequently pulled further back and the closing door 22 follows, guided by the operating device, such that the lower edge of the closing door remains in contact with the front surface 12.2 during the entire movement, until the stamp 12.1 has been pulled back completely out of the filling opening 6 and the closing door 22 has reached its final closed position. Not until then is the locking 30 released, so that the container 2 is removed by longitudinal displacement on the vehicle by the press.

What is claimed is:

1. A vehicle for receiving and transporting refuse materials comprising:

a vehicle frame;

a cab disposed on the vehicle frame;

a collection container detachably connected to and disposed on the vehicle frame behind the cab, the collection container further having:

a front end wall at an end thereof closest to the cab, the front end wall defining a filling opening therein at a lower region thereof, the filling opening being bounded by a rigid frame; and a door disposed at the front end wall and adapted to move for opening and closing the filling opening thereby defining a plane of movement;

an operating device operatively connected to the door for moving the door for opening and closing the filling opening;

a discharge hopper disposed behind the cab and defining an output opening in communication with the filling opening of the collection container, the output opening being bounded by a counterframe disposed adjacent the frame of the filling opening for defining a communication region between the discharge hopper and the collecting container, the discharge hopper further including a tubular extension extending into the filling opening up to the plane of movement of the door;

a press disposed in the discharge hopper and including:

a stamp movable into and out of an interior of the collection container through the filling opening thereby defining, respectively, an advancing motion and a retracting motion, the stamp having an inclined front surface whose upper edge is set back with respect to a lower edge thereof in a direction toward the interior of the collection container; and a drive operatively connected to the stamp for moving the stamp into and out of the interior of the collection container, the operating device and the drive being configured such that, during a closing of the door, a lower edge of the door remains in contact with the front surface of the stamp during the retracting motion of the stamp until the door is completely closed;

a device for receiving a refuse container for emptying contents of the refuse container into the discharge hopper; and a seal disposed on an end face of at least one of the frame and the counterframe for sealing the communication region between the collection container and the discharge hopper.

2. The vehicle according to claim 1, wherein:

the door defines a plurality of receptacles thereon and is guided vertically on the collection container in its movement for opening and closing the filling opening;

the frame of the filling opening includes guides thereon for guiding the door in its movement for opening and closing the filling opening; and the operating device includes:

an operating drive disposed adjacent the output opening of the hopper for moving the door to open and close the filling opening; and a plurality of carriers operatively connected to the drive and adapted to be connected to respective ones of the receptacles for moving the door to open and close the filling opening in response to an actuation of the operating drive.

3. The vehicle according to claim 2, wherein:

the operating device includes a crossbeam disposed above the counterframe and adapted to be guided up and down by the operating drive; and the plurality of carriers comprise mandrel-like carriers disposed on the crossbeam.

4. The vehicle according to claim 3, wherein the operating drive comprises two hydraulic cylinders connected to respective ends of the crossbeam and movable synchronously with respect to one another.

* * * * *